US007374619B2

(12) United States Patent
Fujiwara et al.

(10) Patent No.: US 7,374,619 B2
(45) Date of Patent: May 20, 2008

(54) METHOD AND APPARATUS FOR PRODUCING ADHESIVE TAPE, AND ADHESIVE TAPE

(75) Inventors: Shuzo Fujiwara, Osaka (JP); Kazuhisa Maeda, Osaka (JP); Tetsuo Kishimoto, Osaka (JP); Kunio Nagasaki, Osaka (JP)

(73) Assignee: Nitto Denko Corporation, Osaka (JP)

( * ) Notice: Subject to any disclaimer, the term of this patent is extended or adjusted under 35 U.S.C. 154(b) by 140 days.

(21) Appl. No.: 11/259,195

(22) Filed: Oct. 27, 2005

(65) Prior Publication Data

US 2006/0115646 A1 Jun. 1, 2006

(30) Foreign Application Priority Data

Nov. 26, 2004 (JP) ..... 2004-342307

(51) Int. Cl.
*B05C 11/10* (2006.01)
*B05C 3/12* (2006.01)

(52) U.S. Cl. ..... 118/683; 118/404; 118/405; 118/424; 118/429

(58) Field of Classification Search ..... 156/356, 156/578; 118/404, 405, 683, 423, 424, 427
See application file for complete search history.

(56) References Cited

U.S. PATENT DOCUMENTS 4,407,224 A * 10/1983 Alheid ..... 118/405
RE33,741 E * 11/1991 Boissevain ..... 427/10

FOREIGN PATENT DOCUMENTS

JP 2002-177859 6/2002
JP 2003-053228 2/2003

* cited by examiner

*Primary Examiner*—George Koch
(74) *Attorney, Agent, or Firm*—Cheng Law Group PLLC

(57) ABSTRACT

A method and an apparatus for producing an adhesive tape are disclosed in which an adhesive tape is produced while a liquid reservoir is almost hermetically sealed by bringing a blade into contact with an upper laminate roller, and supplement of adhesive to the liquid reservoir is controlled so that the liquid surface of the adhesive reserved in the liquid reservoir comes into contact with the back face of the blade.

9 Claims, 6 Drawing Sheets

METHOD AND APPARATUS FOR PRODUCING ADHESIVE TAPE, AND ADHESIVE TAPE

BACKGROUND OF THE INVENTION (1) Field of the Invention

The invention relates to a method and apparatus for producing an adhesive tape by supplying and applying an adhesive on a base material, and an adhesive tape.

(2) Description of the Relates Art

Conventionally, an adhesive tape is produced by means of a direct system in which an adhesive is applied as an application solution by an application roller on an elongated base material such as paper, plastic film or the like, or by means of a reverse system. These means are made up of a pair of laminate rollers 40 and 50 on which base materials 90 and 100 are wound, and which are oppositely disposed to each other while facing with a liquid reservoir 80 opened to air, as shown in FIG. 1.

In the above means, when the applying speed is high or when the viscosity of the adhesive is high, in particular, a phenomenon markedly arises that an air cell B in the liquid reservoir 80 is rolled together (involved) with rotation of the upper laminate roller 40. As a measure for avoiding involvement of air cells, for example, the following measures are proposed. First, there is proposed and practiced a measure which separates a liquid reservoir into a front part and a rear part along the width direction of a base material by means of a surface of a base material whose distal end is wound on a lower laminate roller, or by an air cell scraping-off plate provided at a certain interval (see JP-A 2002-177859).

Secondly, there is proposed and practiced a measure in which a suction space is provided in a gap between the bottom of a liquid reservoir and a roller so as to reduce entering of air cells from the gap (see JP-A 2003-53228).

However, these conventional measures suffer from the following problems.

In fact, the first and second measures are effective in removing air cells residing in the bottom of the liquid reservoir and in preventing the air cells from rolled together by the roller. However, these is still a problem that occurrence of air cells in an adhesive is inevitable because air is rolled together from the liquid surface of the liquid reservoir that is open to air with rotation of the upper roller.

In the conventional measures, when an adhesive having a viscosity ranging from 0.1 to 100 Pa·s is used, in particular, it is difficult to remove air cells occurring in the adhesive due to air involved from the liquid surface side, from the side of the bottom of the liquid reservoir.

Therefore, when an air cell occurring in the adhesive due to rotation of a roller is such a large cell that has a diameter ranging from several hundreds micrometers to several millimeters, a through hole occurs in an adhesive layer of a formed adhesive tape, leading deterioration in appearance and quality.

SUMMARY OF THE INVENTION

The invention has been devised in light of the above state in the art, and a primary object of the invention is to provide a method and an apparatus for producing an adhesive tape capable of producing an adhesive tape with improved quality while preventing occurrence of an air cell in the adhesive accompanying with rotation of a roller, as well as to provide an adhesive tape.

In order to achieve such an object, the invention employs the following configurations.

In a method for producing an adhesive tape based on a roll coating method in which an adhesive reserved in a liquid reservoir is fed from a gap formed by a pair of rollers oppositely disposed along the up-and-down direction and applied on a base material wound and traveling on at least one of the rollers, the method comprises the step of:

controlling a supplement amount of the adhesive by covering the liquid reservoir with a blocking member so that the liquid reservoir is almost hermetically sealed while contacting the upper roller, and manipulating pressure of adhesive supplementing means with the use of controlling means so that the liquid surface of the adhesive reserved in the liquid reservoir contacts a back face of the blocking member.

According to the method of the invention, supplement of the adhesive is controlled in such a manner that the liquid reservoir is covered with a blocking member while contacting the upper one of the pair of upper and lower rollers so as to be hermetically sealed, and that the liquid reservoir is securely filled with the adhesive while the liquid surface contacts the back face of the blocking member. Accordingly, it is possible to prevent the adhesive from contacting the air, and prevent occurrence of an air cell in the adhesive due to involvement of air from the liquid surface with rotation of rollers.

As a result, almost no air cell exists in the adhesive applied to the base material that has entered via the boundary with the air. Hence, it is possible to produce an adhesive tape of high quality having excellence appearance with no through hole in the adhesive layer.

In the controlling step, the controlling means calculates a supplement amount of adhesive based on operating conditions including feeding speed of base material, width of base material and thickness of adhesive inputted to the controlling means via an operational unit, and controls an application amount of adhesive to the base material.

Preferably, the blocking member is implemented by an elastic blade. With such a blade, the distal end of the blade contacting the roller suitably bends to follow in the rotating direction of the roller. This effectively eliminates a gap at the contacting position with the roller, from which air is get involved.

Preferably, a radiation curable adhesive containing fine air cells is used. According to this method, it is possible to prevent a large air cell from being involved with rotation of the rollers. Therefore production of a baseless adhesive tape having elasticity is enabled by using an adhesive including fine air cells. Examples of the radiation curable adhesive include adhesives that will photo polymerize under radiation of electric beams, UV beams and the like.

In order to achieve the aforementioned object, the invention employs the following configurations.

In an apparatus for producing an adhesive tape that applies an adhesive on a base material, the apparatus comprises:

a liquid reservoir for reserving the adhesive;

a pair of upper and lower rollers oppositely disposed to each other in the liquid reservoir, on which a base material is wound;

a blocking member contacting the upper roller and almost hermitically sealing the liquid reservoir;

an adhesive supplementing tube having an outlet positioned below a liquid surface of the liquid reservoir;

adhesive supplementing means for feeding an adhesive to the adhesive supplementing tube under pressure; and controlling means for controlling an operation of the adhesive supplementing means so that the liquid surface of the adhesive reserved in the liquid reservoir comes into contact with a back face of the blocking member.

According to the apparatus of the invention, supplement of the adhesive is controlled in such a manner that the liquid reservoir is covered with the blocking member while it contacts the upper one of the pair of upper and lower rollers so as to be hermetically sealed, and that the liquid reservoir is securely filled with the adhesive while the liquid surface comes into contact with the back face of the blocking member.

Accordingly, it is possible to prevent the adhesive from contacting the air, and prevent occurrence of an air cell in the adhesive due to involvement of air from the side of the liquid surface with rotation of the rollers. As a result, almost no air cell exists in the adhesive applied to the base material that has entered via the boundary with the air. Hence, it is possible to produce an adhesive tape of high quality having excellence appearance with no through hole in the adhesive layer.

Preferably, the apparatus further comprises: detecting means for detecting a pressure at which the blocking member comes into contact with the upper roller; and controlling means for controlling a position of the blocking member by controlling an operation of the driving device based on the pressure detected by the detecting means.

According to this arrangement, since the distal end of the blocking member can be brought into contact with the upper roller under application of uniform pressure, the distal end is prevented from being deviatedly abraded. Therefore, this effectively works for preventing involvement of air from the contacting part between the blocking member and the roller. As the blocking member, those having elasticity and having a sharp-pointed end are preferably used. The detecting means is preferably provided in plural along the width direction of the blade. The adhesive supplementing tube is preferably communicatively connected at its outlet for supplying the adhesive with a bottom face of the liquid reservoir.

In order to achieve the aforementioned object, the invention employs the following configurations.

In an apparatus for producing an adhesive tape that applies an adhesive on a base material, the apparatus comprises:

a liquid reservoir for reserving the adhesive;

a pair of upper and lower rollers oppositely disposed to each other, on which the base material is wound;

adhesive supplying means having a wide opening oppositely disposed in a gap between the rollers extending in the width direction of the rollers;

a blocking member provided so as to extend toward the rollers while surrounding the adhesive supplying means, the blocking member facing with the pair of upper and lower rollers and reserving therein the adhesive;

adhesive supplementing tube communicatively connected with the adhesive supplying means;

adhesive supplementing means for feeding an adhesive to the adhesive supplementing tube under pressure; and controlling means for controlling an operation of the adhesive supplementing means so as to adjust a filling amount of the adhesive for the adhesive supplying means.

According to the apparatus of the invention, supplement of the adhesive is controlled in such a manner that the liquid reservoir is covered with the blocking member while it contacts the upper one of the pair of upper and lower rollers so as to be hermetically sealed, and that the liquid reservoir is securely filled with the adhesive while the liquid surface comes into contact with the back face of the blocking member.

Accordingly, it is possible to prevent the adhesive from contacting the air, and prevent occurrence of an air cell in the adhesive due to involvement of air from the side of the liquid surface with rotation of the rollers. As a result, almost no air cell exists in the adhesive applied to the base material that has entered via the boundary with the air. Hence, it is possible to produce an adhesive tape of high quality having excellence appearance with no through hole in the adhesive layer.

Preferably the apparatus further comprises: detecting means for detecting a pressure at which the blocking member comes into contact with the upper roller; and controlling means for controlling a position of the blocking member by controlling an operation of the driving device based on the pressure detected by the detecting means.

According to this arrangement, since the distal end of the blocking member can be brought into contact with the upper roller under application of uniform pressure, the distal end is prevented from being deviatedly abraded. Therefore, this effectively works for preventing involvement of air from the contacting part between the blocking member and the roller. As the blocking member, those having elasticity and having a sharp-pointed end are preferably used. The detecting means is preferably provided in plural along the width direction of the blade. Preferably, an interior of the adhesive supplying means is tapered in the width direction toward a supply port from its proximal end which is communicatively connected with the adhesive supplementing tube.

An adhesive tape of the invention is preferably produced by utilizing a roll coating method in which an adhesive reserved in a liquid reservoir is fed from a gap formed by a pair of rollers oppositely disposed along the up-and-down direction and applied on a base material wound and traveling on at least one of the rollers, while a supplement amount of the adhesive is controlled by covering the liquid reservoir with a blocking member so that the liquid reservoir is almost hermetically sealed while contacting the upper of the rollers, and manipulating pressure of adhesive supplementing means with the use of controlling means so that the liquid surface of the adhesive reserved in the liquid reservoir contacts a back face of the blocking member.

Since the adhesive tape thus produced includes no large air cell in the adhesive, the formed adhesive layer includes no through hole. As a result, it is possible to obtain an adhesive tape of improved appearance and excellent quality. Examples of such an adhesive tape may include an adhesive tape produced by application of an adhesive on either one side of the base material, a two-sided adhesive tape produced by application of an adhesive on both sides of the base material, and the like.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

In the following, embodiments of the invention will be explained with reference to attached drawings.

First Embodiment

Figure 1:
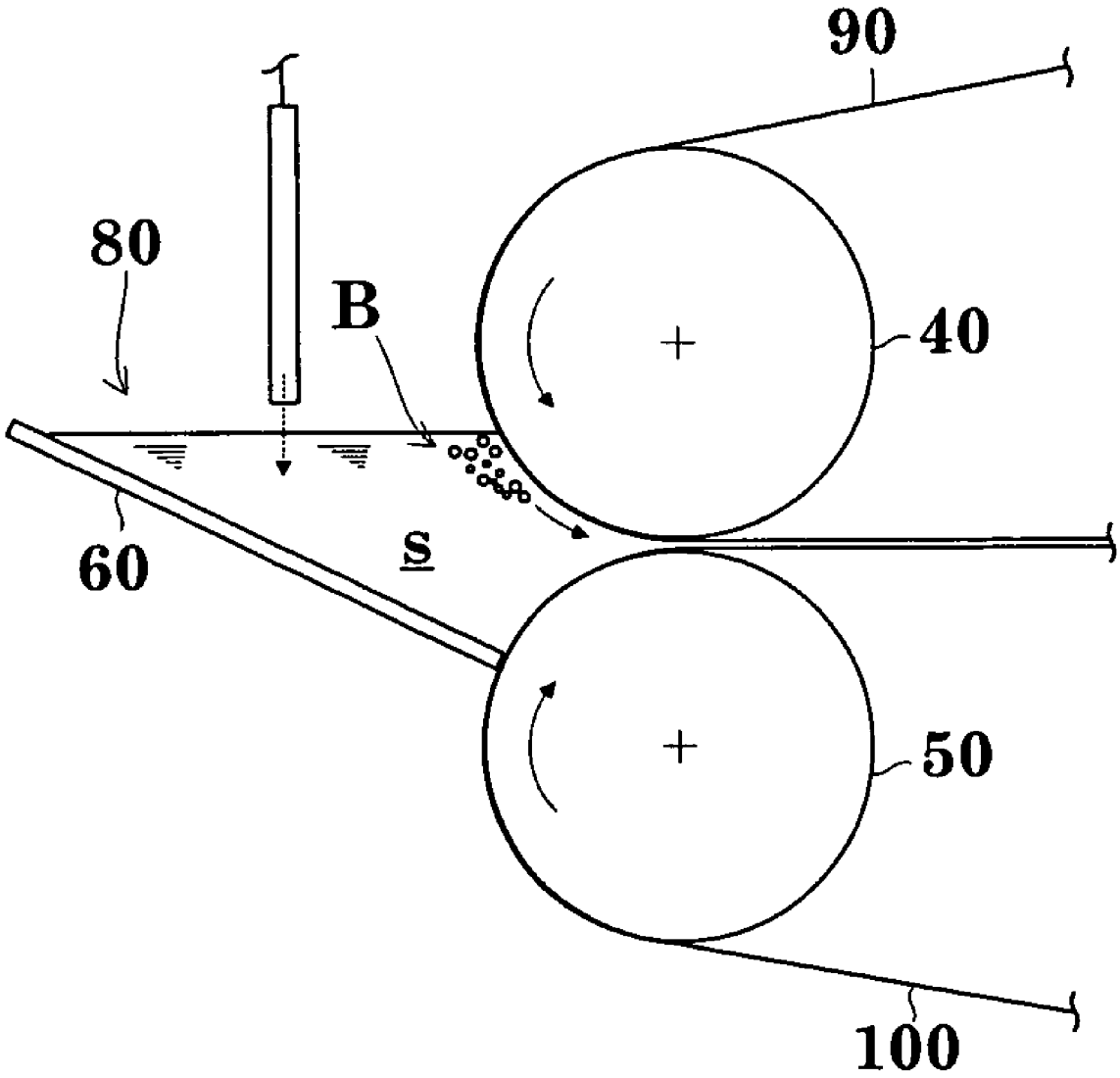
Fig.1 ( PRIOR ART )
FIG. 1 shows a condition in which involvement of air cell occurs in a liquid reservoir of a conventional apparatus.
Figure 2:
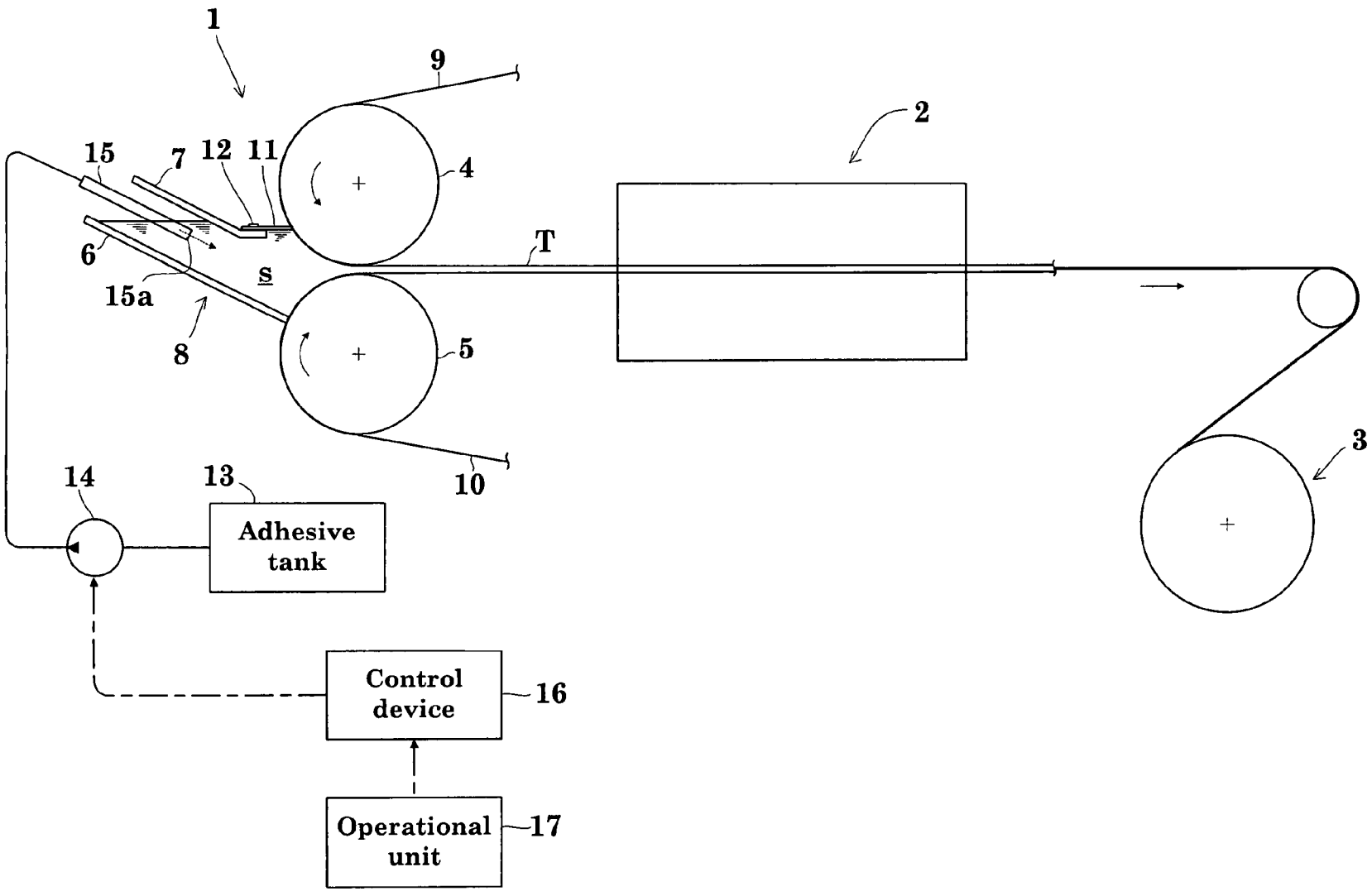
FIG. 2 is a side view showing a schematic structure of an adhesive tape producing apparatus according to a first embodiment of the invention.

FIG. 2 shows a schematic structure of an adhesive tape producing apparatus according to the invention. The adhesive tape producing apparatus includes a roll coater 1 that conveys two base materials while supplying and applying an UV-curable adhesive therebetween, an UV radiator 2 irradiating a adhesive tape T sent from the roll coater 1 with an UV ray to cure the adhesive applied thereon, and a tape collector 3 that winds and collects the complete adhesive tape T after curing of the adhesive.

Figure 3:
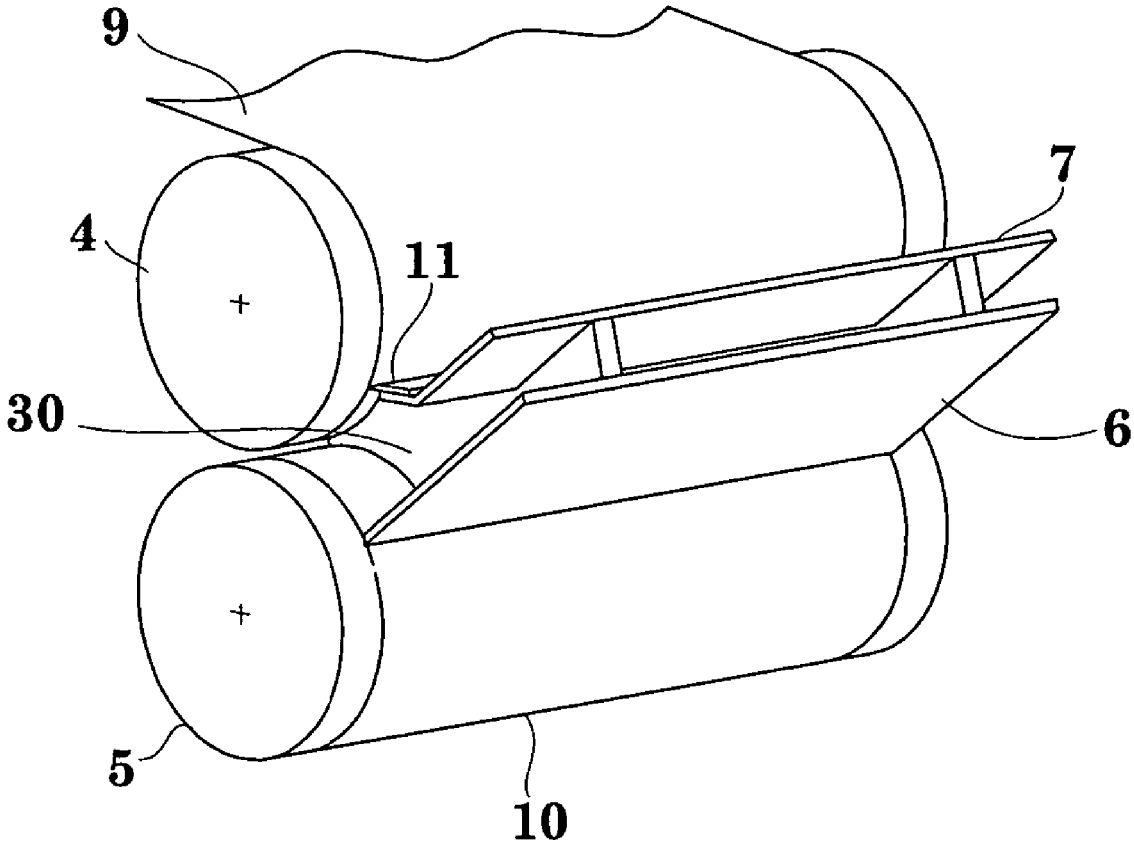
FIG. 3 is a perspective view showing a schematic structure of a roll coater of the adhesive tape producing apparatus according to the first embodiment of the invention.

As shown in FIGS. 2 and 3, the roll coater 1 includes a pair of upper and lower laminate rollers 4 and 5 disposed at a certain interval, and a liquid reservoir 8 surrounded by a bottom plate 6, a top plate 7 and a lateral plate 30 for liquid reservoir. The roll coater 1 conveys base materials 9 and 10 wound on the laminate rollers 4 and 5 while supplying and applying an adhesive S therebetween by simultaneously rotating the laminate rollers 4 and 5 in the condition that the adhesive S is reserved in the liquid reservoir 8, to thereby form an adhesive tape T. The laminate rollers 4 and 5 constituting the roll coater 1 correspond to rollers of the invention.

The top plate 7 constituting the liquid reservoir 8 covers a part of a liquid surface of the reserved adhesive S, and has a blade 11 supported by an end part of the top plate 7 in a cantilever manner so as to face with the laminate roller 4. The blade 11 corresponds to a blocking member of the invention.

The blade 11 is flexible and processed so that a distal end thereof is tapered to have an almost sharp-pointed end. In other words, the blade 11 comes into contact with the laminate roller 4, and thereby the liquid reservoir is almost hermetically sealed. Preferably, the blade 11 is flexible and made of resin.

The blade 11 may be slidably adjusted in the fore-and-aft direction relative to the laminate roller 4 by loosing a screw 12 that is attached and fixed to the top plate 7.

In the apparatus of the present embodiment, the adhesive S fed by a supplementing pump 14 from an adhesive tank 13 is supplemented to the liquid reservoir 8 via a supplementing tube 15. The supplementing pump 14 and the supplementing tube 15 respectively correspond to adhesive supplementing means and adhesive supplementing tube of the invention.

The supplementing pump 14 is implemented by a motor-driven or electromagnetically driven pump connected with a control device 16. The control device 16 optionally controls a discharge rate of the adhesive tank 13 by regulating pressure of the supplementing pump 14. An operational unit 17 is connected to the control device 16. Based on operational conditions such as conveying speed of base material, width of base material, thickness of adhesive entered on this operational unit 17, the control device 16 calculates an application amount, and the same amount of adhesive as the application amount (consumed amount) is supplemented. These settings ensure the liquid surface of the adhesive S in the liquid reservoir 8 to be stably kept so that it contacts the back face of a blocking member 11.

The supplementing tube 15 for the adhesive S is inserted into the liquid reservoir 8 from above. The supplementing tube 15 is so designed that a supplementing port 15*a*, which is a lower end of the supplementing tube 15, is at a level lower than the liquid surface of the adhesive S by a predetermined dimension. With this design, it is possible to prevent involvement of an air cell by the supplemented adhesive S. The predetermined distance is preferably 40 mm or more.

Exemplary results of production tests of adhesive tape using the method and apparatus of the invention will be described below.

(Test 1)

An adhesive used in Test 1 was prepared as follows. To 90 parts by weight of 2EHA and 10 parts by weight of AA, 0.1 part by weight of 2,2-dimethoxy-1,2-diphenylethane-1-one which is a photo polymerization initiator was introduced into a stirred tank, and then the interior of the stirred tank was irradiated with ultraviolet rays using an optical fiber-type UV device, so that the viscosity was increased to approximately 30 Pa·s. Thereafter, to 100 parts by weight of this liquid, 0.3 part by weight of 2,2-dimethoxy-1,2-diphenylethane-1-one which is a photo polymerization initiator and 0.2 part by weight of hexanediol diacrylate which is a crosslinking agent were mixed and stirred to produce the objective adhesive.

As a base material (supporting member) wound on the laminate rollers 4 and 5 of the apparatus of the present embodiment, a transparent PET separator having a thickness of 50 μm in which nonadhesive treatment is applied on the coating surface of the adhesive is used.

The gap space between the laminate rollers 4 and 5 was adjusted so that the thickness of the adhesive after application of adhesive to the base material followed by lamination using the above adhesive and base material is 200 μm. The base materials were rolled out at a speed of about 5 m/min, and a high-pressure mercury vapor lamp was used in the UV radiator. Curing treatment of adhesive was conducted by irradiating an adhesive tape with UV rays using the above UV radiator set in the conditions of about 300 $mW/cm^2$ of maximum illumination, and 4000 $mJ/cm^2$ of integrated light quantity.

In the adhesive layer of the adhesive tape produced in the above conditions, no through hole due to entering of a large air cell having a diameter of several hundreds to several thousands micrometers was observed, and an well-finished baseless two-sided adhesive tape was observed.

(Test 2)

An adhesive used in Test 2 was prepared as follows. To 90 parts by weight of 2EHA and 10 parts by weight of AA, 0.1 part by weight of 2,2-dimethoxy-1,2-diphenylethane-1-one which is a photo polymerization initiator was introduced into a stirred tank, and then the interior of the stirred tank was irradiated with ultraviolet rays using an optical fiber-type UV device, so that the viscosity was increased to approximately 30 Pa·s. Thereafter, to 100 parts by weight of this liquid, 0.3 part by weight of 2,2-dimethoxy-1,2-diphenylethane-1-one which is a photo polymerization initiator and 0.2 part by weight of hexanediol diacrylate which is a crosslinking agent were mixed and stirred. Then 10 parts by weight of glass balloon (made by Tokai Kogyo Co., Ltd.) was stirred and mixed. Further, about 15% vol. ratio of nitrogen was mixed and dispersed in an adhesive by means of a mixer, for example, by a rotary stirring and mixing machine, to produce an objective adhesive.

As a base material (supporting member) wound on the laminate rollers 4 and 5 of the apparatus of the present embodiment, a transparent PET separator having a thickness of 50 μm in which nonadhesive treatment is applied on the coating surface of the adhesive is used.

The gap space between the laminate rollers 4 and 5 was adjusted so that the thickness of the adhesive after application of adhesive to the base material followed by lamination using the above adhesive and base material is 1 mm. The base materials were rolled out at a speed of about 5 m/min, and in the UV radiator a high-pressure mercury vapor lamp was used to set maximum illumination at about 300 $mW/cm^2$, and integrated light quantity at 4000 $mJ/cm^2$. In this condition, curing treatment of adhesive was conducted by irradiating an adhesive tape with UV rays.

In the adhesive layer of the adhesive tape produced in the above conditions, although fine air cells originally exist are contained, no through hole due to entering of a large air cell having a diameter of several hundreds to several thousands micrometers was observed, and an well-finished two-sided adhesive tape having elasticity was observed.

Second Embodiment

In the present embodiment, a liquid reservoir 8 is differently arranged from that of the first embodiment. Therefore, the same components are denoted by the same reference numerals and concrete explanation will be given only for different parts.

Figure 4:
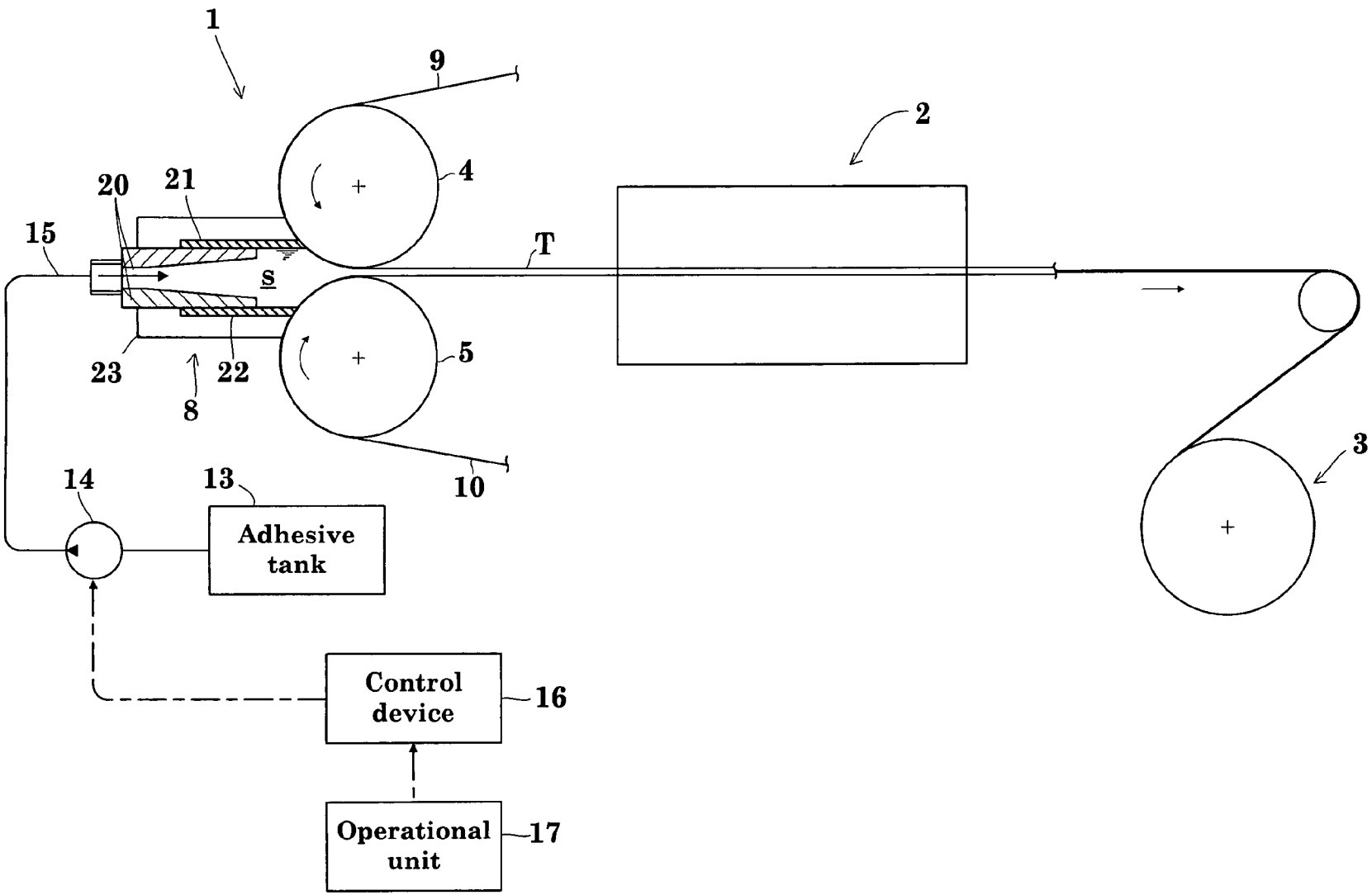
FIG. 4 is a side view showing a schematic structure of an adhesive tape producing apparatus according to a second embodiment of the invention.
Figure 5:
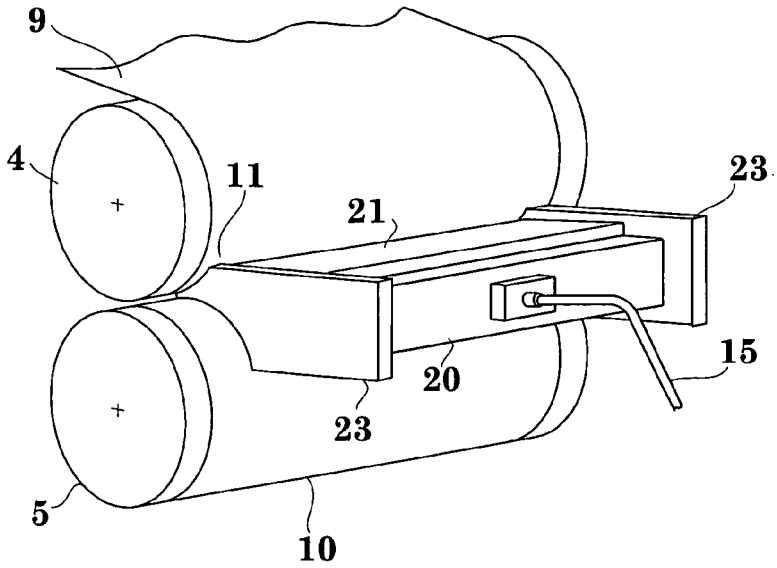
FIG. 5 is a perspective view showing a schematic structure of a roll coater of the adhesive tape producing apparatus according to the second embodiment of the invention.
Figure 6:
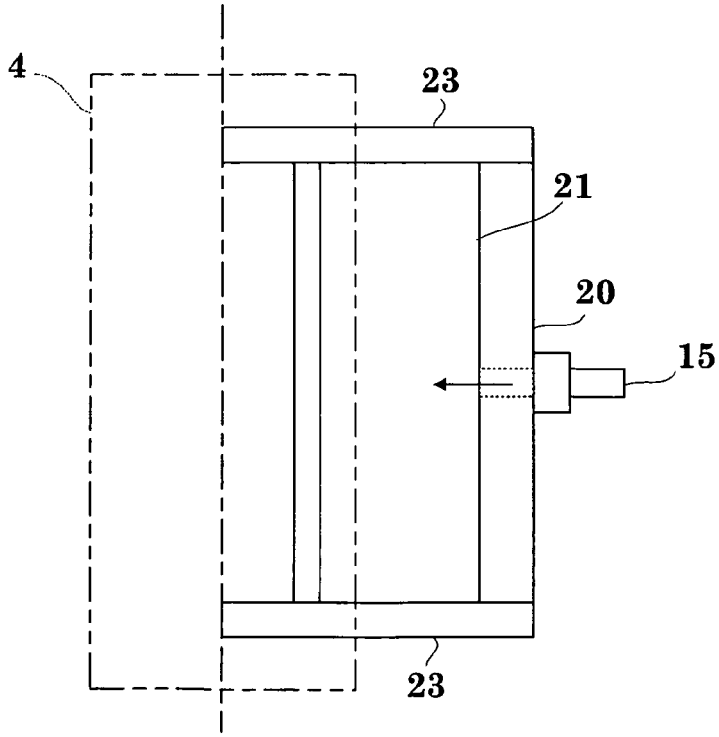
FIG. 6 is a sectional view of a plane of a feeding path according to the second embodiment of the invention.

As shown in FIGS. 4 and 5, the liquid reservoir 8 has a side cross section of laterally turned U shape. The liquid reservoir 8 is surrounded by an adhesive supply head 20 which is a rectangular cylinder extending in the width direction of a roll coater 1, a top plate 21 and a bottom plate 22 which are plate members closely contacting a top face, a bottom face and side faces of the adhesive supply head 20 and movably attached in the fore-and-aft direction with their distal ends protruding from the adhesive supply head 20, and a lateral plate 23 attached on each lateral side. Positions of distal ends of these plate members 21 to 23 are controlled so as to face with the roll coater 1. Preferably, these plate members 21 to 23 are processed with fluorine to impart excellent slidability.

To a proximal end of the adhesive supply head 20, a supplementing tube 15 for supplying and supplementing an adhesive S to the interior is communicatively connected. More specifically, the adhesive supply head 20 has an opening having almost the same width as a gap width of the roll coater 1 and supplies the adhesive S radially toward the gap in the width direction of roller. The adhesive supply head 20 corresponds to adhesive supplying means and the top plate 21, the bottom plate 22 and both lateral plates 23 correspond to a blocking member of the invention.

With the above arrangement, the almost hermetically sealed liquid reservoir 8 is filled with the supplied adhesive. Therefore, the adhesive S supplied to the roll coater 1 will not contact atmospheric air until it is applied to the base materials 9 and 10. In brief, the structure of the roll coater 1 in the second embodiment is able to prevent occurrence of involvement of air from the side of the liquid surface.

Exemplary results of production tests of adhesive tape using the apparatus of the invention will be described below.

(Test 3)

An adhesive used in Test 3 was prepared as follows. To 90 parts by weight of 2EHA and 10 parts by weight of AA, 0.1 part by weight of 2,2-dimethoxy-1,2-diphenylethane-1-one which is a photo polymerization initiator was introduced into a stirred tank, and then the interior of the stirred tank was irradiated with ultraviolet rays using an optical fiber-type UV device, so that the viscosity was increased to approximately 30 Pa·s. Thereafter, to 100 parts by weight of this liquid, 0.3 part by weight of 2,2-dimethoxy-1,2-diphenylethane-1-one which is a photo polymerization initiator and 0.2 part by weight of hexanediol diacrylate which is a crosslinking agent were mixed and stirred to produce the objective adhesive.

As a base material (supporting member) wound on the laminate rollers 4 and 5 of the apparatus of the present embodiment, a transparent PET separator having a thickness of 50 μm in which nonadhesive treatment is applied on the coating surface of the adhesive is used.

The gap space between the laminate rollers 4 and 5 was adjusted so that the thickness of the adhesive after application of adhesive to the base material followed by lamination using the above adhesive and base material is 200 μm. The base materials were rolled out at a speed of about 5 m/min, and in the UV radiator a high-pressure mercury vapor lamp was used to set maximum illumination at about 300 $mW/cm^2$, and integrated light quantity at 4000 $mJ/cm^2$. In this condition, curing treatment of adhesive was conducted by irradiating an adhesive tape with UV rays.

In the adhesive layer of the adhesive tape produced in the above conditions, although fine air cells that originally exist are contained, no through hole due to entering of a large air cell having a diameter of several hundreds to several thousands micrometers was observed, and an well-finished baseless two-sided adhesive tape was observed.

(Test 4)

An adhesive used in Test 4 was prepared as follows. To 90 parts by weight of 2EHA and 10 parts by weight of AA, 0.1 part by weight of 2,2-dimethoxy-1,2-diphenylethane-1-one which is a photo polymerization initiator was introduced into a stirred tank, and then the interior of the stirred tank was irradiated with ultraviolet rays using an optical fiber-type UV device, so that the viscosity was increased to approximately 30 Pa·s. Thereafter, to 100 parts by weight of this liquid, 0.3 part by weight of 2,2-dimethoxy-1,2-diphenylethane-1-one which is a photo polymerization initiator and 0.2 part by weight of hexanediol diacrylate which is a crosslinking agent were mixed and stirred. Then 10 parts by weight of glass balloon (made by Tokai Kogyo Co., Ltd.) was stirred and mixed. Further, about 15% vol. ratio of nitrogen was mixed and dispersed in an adhesive by means of a mixer, for example, by a rotary stirring and mixing machine, to produce an objective adhesive.

As a base material (supporting member) wound on the laminate rollers 4 and 5 of the apparatus of the present embodiment, a transparent PET separator having a thickness of 50 μm in which nonadhesive treatment is applied on the coating surface of the adhesive is used.

The gap space between the laminate rollers 4 and 5 was adjusted so that the thickness of the adhesive after application of adhesive to the base material followed by lamination using the above adhesive and base material is 1 mm. The base materials were rolled out at a speed of about 5 m/min, and in the UV radiator a high-pressure mercury vapor lamp was used to set maximum illumination at about 300 $mW/cm^2$, and integrated light quantity at 4000 $mJ/cm^2$. In this condition, curing treatment of adhesive was conducted by irradiating an adhesive tape with UV rays.

In the adhesive layer of the adhesive tape produced in the above conditions, although fine air cells that originally exist are contained, no through hole due to entering of a large air cell having a diameter of several hundreds to several thousands micrometers was observed, and an well-finished two-sided adhesive tape having elasticity was observed.

As the base materials used in the above first and second embodiments, paper materials (e.g., Japanese paper, kraft paper), fabric materials (cotton, staple fiber, chemical fiber, nonwoven cloth), for example, are mainly used, however, plastics (cellophane, polypropyrene, ethylene-propylene copolymer, polyester, polyethylene, polyvinylchloride, acetate, polystyrene, polyacrylonitrile and the like), metal foils, or plastic laminates thereof may be used.

As an adhesive, acrylic, polyester, epoxy or the like photo-polymerizable compositions containing a monomer or its partially polymerized substance and a photo polymerization initiator, which polymerize in response to light irradiation to become adhesives are used. Among these, acrylic photo-polymerizable composition is particularly preferably used. Examples of each component of a photo polymerizable composition used in the present embodiment will be recited below.

In the present embodiment, monomers based on alkyl acrylate monomer, and copolymerizable monomers having a polar group are used as a photo-polymerizable composition. The alkyl acrylate monomer used in the present embodiment refers to a vinyl monomer based on (meth)acrylic acid alkyl ester, and concretely, one kind or two or more kinds of monomers having 1 to 14 carbons in an alkyl group, for example, alkyl esters of acrylic acid or methacrylic acid having an alkyl group like methyl group, ethyl group, propyl group, butyl group, isobutyl group, pentyl group, isopentyl group, hexyl group, heptyl group, octyl group, isooctyl group, nonyl group, isononyl group, decyl group or isodecyl group, or derivative thereof whose alkyl group is partially substituted by a hydroxyl group is/are used as main component.

As a copolymerizable monomer having a polar group, unsaturated acids such as (meth)acrylic acid, itaconic acid and 2-acrylamide propane sulfonic acid, hydroxyl group-containing monomers such as 2-hydroxyethyl(meth)acrylate and 2-hydroxypropyl(meth)acrylate, and caprolactone (meth)acrylate and the like are used. Besides monomers, dimmers such as (meth)acrylic acid dimmers may be used.

Examples of the photo polymerization initiator used in the present embodiment include benzoin ethers such as benzoin methylether and benzoin isopropylether; substituted benzoin ethers such as anisole methylether; substituted acetophenones such as 2,2-diethoxy acetophenone and 2,2-dimethoxy-2-phenyl acetophenone; substituted-α-ketols such as 2-methyl-2-hydroxypropiophenone; aromatic sulfonyl chlorides such as 2-naphthalene sulfonyl chloride; photoactive oximes such as 1-phenyl-1,1-propanedione-2-(o-ethoxycarbonyl)-oxime; and the like. Use amount of such a photo polymerization initiator is usually in the range of 0.1 to 5 parts by weight, more preferably in the range of 0.1 to 3 parts by weight, with respect to 100 parts by weight of the sum of the monomer(s) based on the alkyl acrylate monomers as described above and the photo polymerizable monomer having a polar group. If the use amount of the photo polymerization initiator is less than the above specified range, the polymerization speed decreases, so that the monomers are more likely to remain, which is not desired in terms of the industrial view. To the contrary, if the use amount is larger than the specified range, a molecular weight of the resultant polymer decreases, which may lead reduction in aggregation of the resultant adhesive. Hence, desirable adhesive characteristics are no longer achieved.

Examples of the crosslinking agent used in the present embodiment include multifunctional acrylate monomers, such as two or more functional alkyl acrylate monomers, e.g., trimethyrol propane triacrylate, pentaerythritol tetraacrylate, 1,2-ethyleneglycol diacrylate, 1,6-hexanediol diacrylate, 1,12-dodecanediol diacrylate, and the like. The use amount of the multifunctional acrylate monomer depends on the number of functional groups and the like, however, in general, it is in the range of 0.01 to 5 parts by weight, more preferably in the range of 0.1 to 3 parts by weight, with respect to 100 parts by weight of the sum of the monomer(s) based on the alkyl acrylate monomers as described above and the photo polymerizable monomer having a polar group. Use of a multifunctional acrylate monomer in an amount falling in this range ensures excellent aggregation.

Beside the above multifunctional acrylate, a crosslinking agent may be additionally used in accordance with the use application of the adhesive. As the crosslinking agent additionally used, crosslinking agents that are commonly used such as isocyanate crosslinking agents, epoxy crosslinking agent, aziridine crosslinking agents and the like may be used. In the invention, an additive such as adhesion giving agent may be used as necessary.

As described above, the liquid reservoir 8 is almost hermetically sealed by bringing the distal end of the blade 11 into contact with the laminate roller 4, and the adhesive S reserved in the liquid reservoir 8 is filled and kept so that the liquid surface thereof is in contact with the back face of the blade 11. Accordingly, it is possible to prevent occurrence of a large air cell having a diameter of several hundreds to several thousands micrometers caused by involvement of air from the side of the liquid surface with rotation of the laminate roller 4. As a result, when an adhesive tape is produced by irradiating an adhesive applied as a laminate between the base materials 9 and 10 with UV rays to make it cured through photo polymerization, it is possible to produce an adhesive tape of excellent quality with suppressed occurrence of a through hole due to involvement of an air cell into its adhesive layer, and without any defect in appearance.

Besides the foregoing embodiment, the invention may be embodied in modified manners as follows.

(1) In the first embodiment, the contact position with the laminate roller 4 has been adjusted by slidingly moving the blade 11 by loosing the screw 12 for fixing the blade 11 to the top plate 7; however, adjustment may be achieved in the following manners.

For example, a pressure sensor which is detecting means is provided at a predetermined interval in the width direction of the blade 11. Then, based on a detection result by this pressure sensor, the blade 11 may be slidingly moved by a driving device such as a cylinder, so that the distal end of the blade 11 contacts the laminate roller 4 along its width direction at a constant and uniform pressure, whereby the adjustment may be achieved. As to the second embodiment, as is the same with this arrangement, a position of a distal end of at least either of the top plate 21 and the bottom plate 22 may be adjusted.

(2) In the case of the first embodiment, the adhesive supplementing tube 15 may be connected with the bottom plate 6 of the liquid reservoir, and the supplementing port 15*a* may be provided under the liquid surface.

(3) In each foregoing embodiment, the base materials 9 and 10 are respectively wound on the laminate rollers 4 and 5 and the adhesive S was supplied and applied therebetween, however, the adhesive S may be applied with only the base material 9 wound on the laminate roller 5.

(4) In the first embodiment, the blade 11 covers the liquid surface excluding the part where the adhesive S is supplied, however, the following arrangement is also acceptable.

For example, a certain region of the liquid surface neighboring the laminate roller 4 where air is likely to be involved with rotation of the laminate rollers 4 is covered with the blade 11 so as to contact the laminate roller 4, and the liquid surface other than the predetermined region may be open to atmospheric air. Similar effects obtained by the forgoing embodiments can also be realized in this arrangement.

(5) In the foregoing embodiments, UV-curable adhesives are used, however, the invention is also applicable to adhesives that polymerize under irradiation of radial rays including electron beams.

Figure 7:
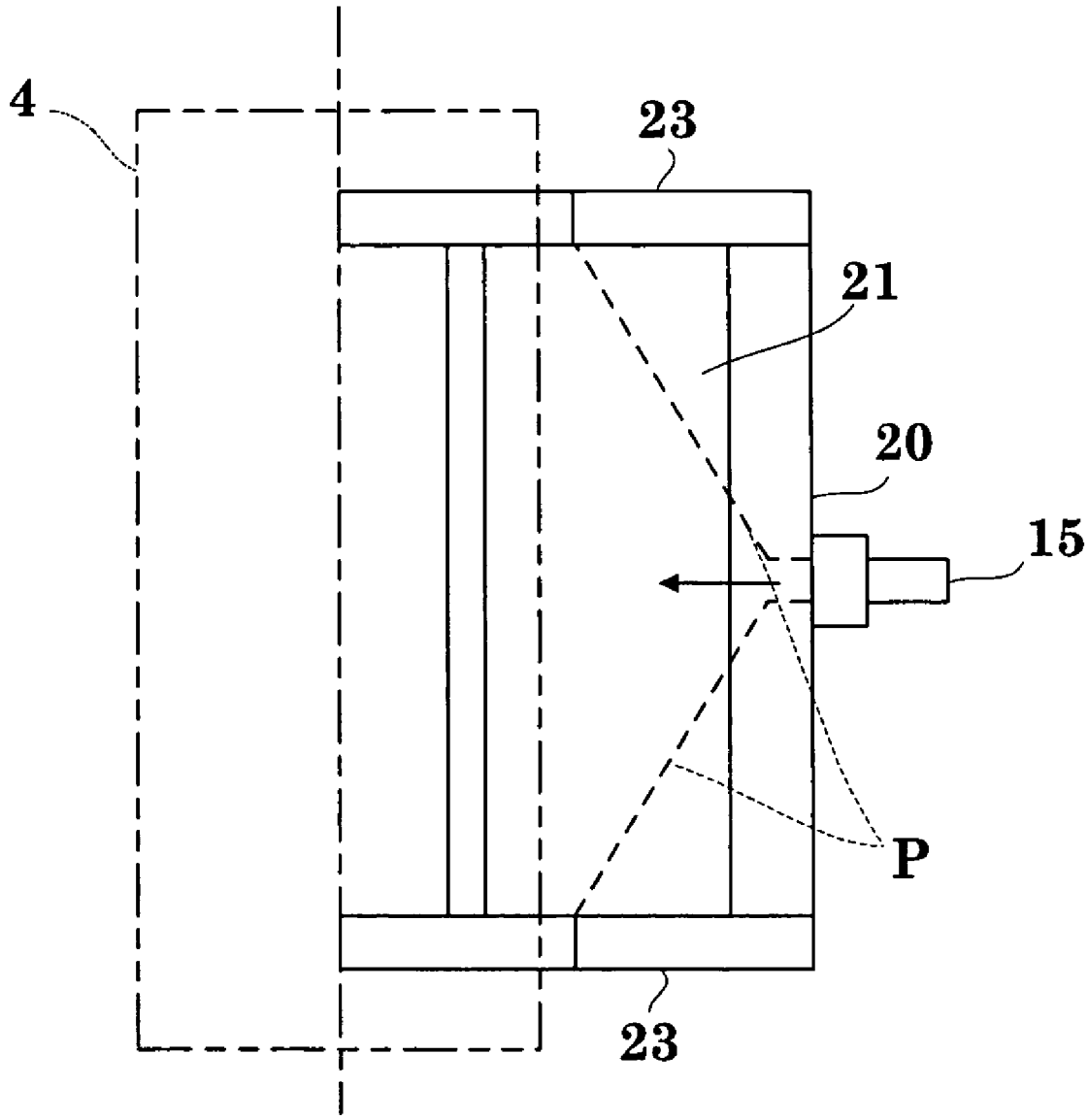
FIG. 7 is a sectional view of a plane showing a feeding path in a modified apparatus.

(6) In the second embodiment, the cross section of the lateral side of the adhesive supply head 20 is of a laterally turned U shape, and the flow path is rectangular. Alternative to this arrangement, as shown in the broken lines in plan view of FIG. 7, the flow path may be formed to broaden toward the roll coater 1 from the thin proximal end connecting with the supplementing tube 15.

The present invention may be embodied in other specific forms without departing from the spirit or essential attributes thereof and, accordingly, reference should be made to the appended claims, rather than to the foregoing specification, as indicating the scope of the invention.

What is claimed is:

1. An apparatus for producing an adhesive tape that applies an adhesive on a base material, the apparatus comprising:

a liquid reservoir for reserving the adhesive;

a pair of upper and lower rollers oppositely disposed to each other in the liquid reservoir, on which a base material is wound;

a blocking member having a distal end and a back face facing into the reservoir, the blocking member extending horizontally so that the distal end contacts the upper roller and almost hermitically sealing the liquid reservoir;

an adhesive supplementing tube having an outlet positioned below a liquid surface of the liquid reservoir;

adhesive supplementing means for feeding an adhesive to the adhesive supplementing tube under pressure; and controlling means for controlling an operation of the adhesive supplementing means so that a top liquid surface of the adhesive reserved in the liquid reservoir continuously comes into contact with the back face of the blocking member.

2. The apparatus according to claim 1, further comprising:

a driving device that moves the blocking member towards and away from the upper roller in a horizontal plane so that the distal end of the blocking member comes into horizontal contact with the upper roller;

detecting means for detecting a pressure at which the blocking member comes into contact with the upper roller; and controlling means for controlling a position of the distal end of the blocking member so as to come into continuous contact with the upper roller by controlling an operation of the driving device based on the pressure detected by the detecting means.

3. The apparatus according to claim 2, wherein the blocking member is elastic, and has the distal end formed into a sharp-pointed blade, and the detecting means is provided in plural along the width direction of the blade.

4. The apparatus according to claim 1, wherein the adhesive supplementing tube is inserted at its outlet end into the interior of the liquid reservoir through the liquid surface of the adhesive.

5. The apparatus according to claim 1, wherein the adhesive supplementing tube is communicatively connected at its outlet for supplementing the adhesive with the bottom face of the liquid reservoir.

6. An apparatus for producing an adhesive tape that applies an adhesive on a base material, the apparatus comprising:

a liquid reservoir for reserving the adhesive;

a pair of upper and lower rollers oppositely disposed to each other, on which the base material is wound;

adhesive supplying means having a wide opening oppositely disposed in a gap between the rollers extending in the width direction of the rollers;

a blocking member including a top plate, a bottom plate and a pair of lateral plates connecting the top plate and bottom plate together and extending toward the rollers while surrounding the adhesive supplying means, the blocking member facing the pair of upper and lower rollers and reserving therein the adhesive, the top plate horizontally contacting the upper roller and the bottom plate horizontally contacting the lower roller;

adhesive supplementing tube communicatively connected with the adhesive supplying means;

adhesive supplementing means for feeding an adhesive to the adhesive supplementing tube under pressure; and controlling means for controlling an operation of the adhesive supplementing means so as to adjust a filling amount of the adhesive for the adhesive supplying means.

7. The apparatus according to claim 6, further comprising:

a driving device that horizontally moves the blocking member so that respective ones of the top plate and the bottom plate moves toward and away from respective ones of the upper and lower rollers;

detecting means for detecting a pressure at which the blocking member comes into contact with the upper roller; and controlling means for controlling a position of the blocking member by controlling an operation of the driving device based on the pressure detected by the detecting means.

8. The apparatus according to claim 7, wherein the blocking member is elastic, and has a distal end formed into a sharp-pointed blade, and the detecting means is provided in plural along the width direction of the blade.

9. The apparatus according to claim 6, wherein the adhesive supplying means has an interior tapered in the width direction toward a supply port from its proximal end which is communicatively connected with the adhesive supplementing tube.

* * * * *